US007293832B2

(12) United States Patent
Huang

(10) Patent No.: US 7,293,832 B2
(45) Date of Patent: Nov. 13, 2007

(54) CHAIR ADJUSTABLE DEVICE

(76) Inventor: Chien-Kai Huang, No. 136, Tsu Chiang Road, Chang Hua City (TW)

( * ) Notice: Subject to any disclaimer, the term of this patent is extended or adjusted under 35 U.S.C. 154(b) by 111 days.

(21) Appl. No.: 11/206,848

(22) Filed: Aug. 19, 2005

(65) Prior Publication Data

US 2007/0040433 A1 Feb. 22, 2007

(51) Int. Cl.
*A47C 1/024* (2006.01)

(52) U.S. Cl. ..... 297/300.8; 297/300.7; 297/301.6; 297/463.1; 297/301.7; 297/301.4

(58) Field of Classification Search ..... 297/300.8, 297/300.7, 301.6, 301.7, 301.4, 463.1, 463.2
See application file for complete search history.

(56) References Cited

U.S. PATENT DOCUMENTS 4,779,925 A * 10/1988 Heinzel ..... 297/300.4
4,966,411 A * 10/1990 Katagiri et al. ..... 297/300.7
5,762,399 A * 6/1998 Liu ..... 297/302.7
6,033,020 A * 3/2000 Ito ..... 297/302.4
6,276,755 B1 * 8/2001 Su ..... 297/285
6,921,134 B1 * 7/2005 Hong ..... 297/301.7
7,080,884 B2 * 7/2006 Daeschle et al. ..... 297/303.4

* cited by examiner

*Primary Examiner*—David Dunn
*Assistant Examiner*—Erika Garrett
(74) *Attorney, Agent, or Firm*—Bacon & Thomas, PLLC

(57) ABSTRACT

A chair adjustable device includes a base with which a seat frame and a backrest frame are respectively and pivotably connected. A positioning mechanism is connected to the base and includes an operation handle which is able to shift a transmission frame and a positioning plate is movably connected to the transmission frame and biased by a spring, so that the positioning plate can be movably engaged with one of notches defined in a positioning member on the seat frame. The seat frame and the backrest frame are connected by a connection member so that the chair can be adjusted its tilt angle by operating the operation handle.

6 Claims, 13 Drawing Sheets

CHAIR ADJUSTABLE DEVICE

FIELD OF THE INVENTION

The present invention relates to a chair adjustable device for adjusting tilt angles of the backrest and the seat portion of chairs.

BACKGROUND OF THE INVENTION

A conventional chair adjustable device of a chair 60 is shown in FIG. 9 and generally includes a base 61 with a seat frame 62 and a backrest frame 63 respectively pivotably connected thereto. A pivot frame 64 extends from an underside of the seat frame 62 and the backrest frame 63 includes a hole 65 defined in a middle portion thereof and a pin 66 extends through the hole 65 and the pivot frame 64. The backrest is connected to the other end of the backrest frame 63. The backrest is pivoted, the backrest frame 63 is pivoted about a pivot end 67 of the base 61 and moves the pivot frame 64 which drives the seat frame 62 by the pin 66 and is rotated about the pivot end 68 of the base 61. U.S. Pat. No. 6,488,336 discloses a backrest adjustment device as shown in FIGS. 10 and 11, which includes a base 70 with a board 71 and an operation handle 80 is connected base 70. The handle 80 has a connection plate 81 and a pressing plate 82 to press on the pneumatic seat post 72. The board 71 includes a rail 731, a chamber 732 and guide frame 73 which includes a guide slot 733. A slidable frame 74 is slidably connected to the guide frame 73 and includes an inclined passage 741 and a lug 742. The slidable frame 74 is connected to the connection plate 81 of the handle 80 by a pivot 75 and a spring 76, so that the slidable frame 74 drives a positioning plate 77 which is movably engaged with the inclined passage 741. The positioning plate 77 protrudes from the guide frame 73 and can be engaged with the notches 91 in the seat frame 90 to position the seat frame 90.

For the device disclosed in FIG. 9, because the pivot frame 64 and the seat frame 62 are fixed with each other, the hole 65 must be large enough to allow the backrest frame 63 to be tilted. Nevertheless, when the backrest is pivoted back to its original position, the hole 65 is scrubbed by the pin 66 so that the inner diameter of the hole 65 becomes larger and larger which causes shaking of the backrest and makes the user feel uncomfortable. For the device disclosed in FIGS. 10 and 11, the mechanism is too complicated. When the handle 80 is pulled, the connection plate 81 and the pivot are moved to let the spring 76 move the slidable frame 74 which is moved along the rail 731 so that a component force coming from the inclined passage 741 moves the positioning plate 77. The movement is achieved by many indirect movements of different parts so that severe friction happens between these parts.

U.S. Pat. No. 6,378,943 discloses a chair tilt lock mechanism wherein the mechanism includes two springs 42, 44 and 92, 94, and 142, 144 to move slider 36 or the arm 136 so as to lock the tilt device. However, the two springs have to carefully set their modulus of elasticity and spring force, or the locking function cannot be precisely proceeded. Another U.S. Pat. No. 6,033,020 employs torsion spring 43 to drive the transmission part 42 so as to move the positioning plate 8 to engage with the notch 7. The positioning plate 8 is moved spirally by the torsion spring 43 so that the positioning plate 8 might not be functioned at the beginning of movement and noise due to impact between parts may happen.

SUMMARY OF THE INVENTION

The present invention relates to a chair adjustable device comprises a base with a seat frame and a backrest frame respectively pivotably connected thereto. A connection member is located at an underside of the backrest frame and pivotably connects the backrest frame and the seat frame. A positioning mechanism is connected to the base and an operation handle movably extends through the base and is movably engaged with a fixed member. A transmission frame is connected to a side of the operation handle and movable with the operation handle. A positioning plate is movably connected to the transmission frame and biased by a spring so that the positioning plate can be engaged with one of notches defined in a positioning member on the seat frame so as to control the inclination of the chair.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
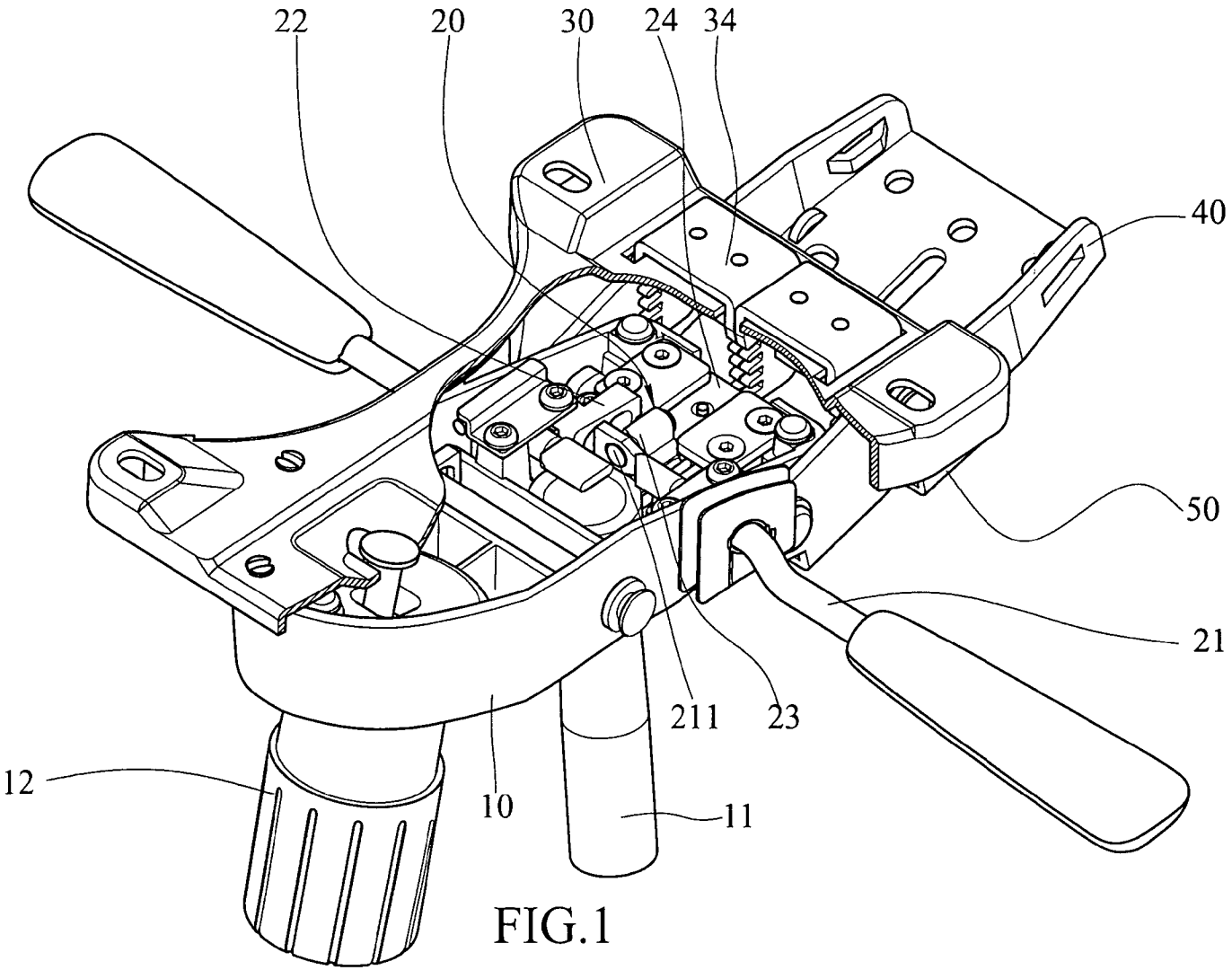
FIG. 1 is a perspective view of the chair adjustable device of the present invention.
Figure 2:
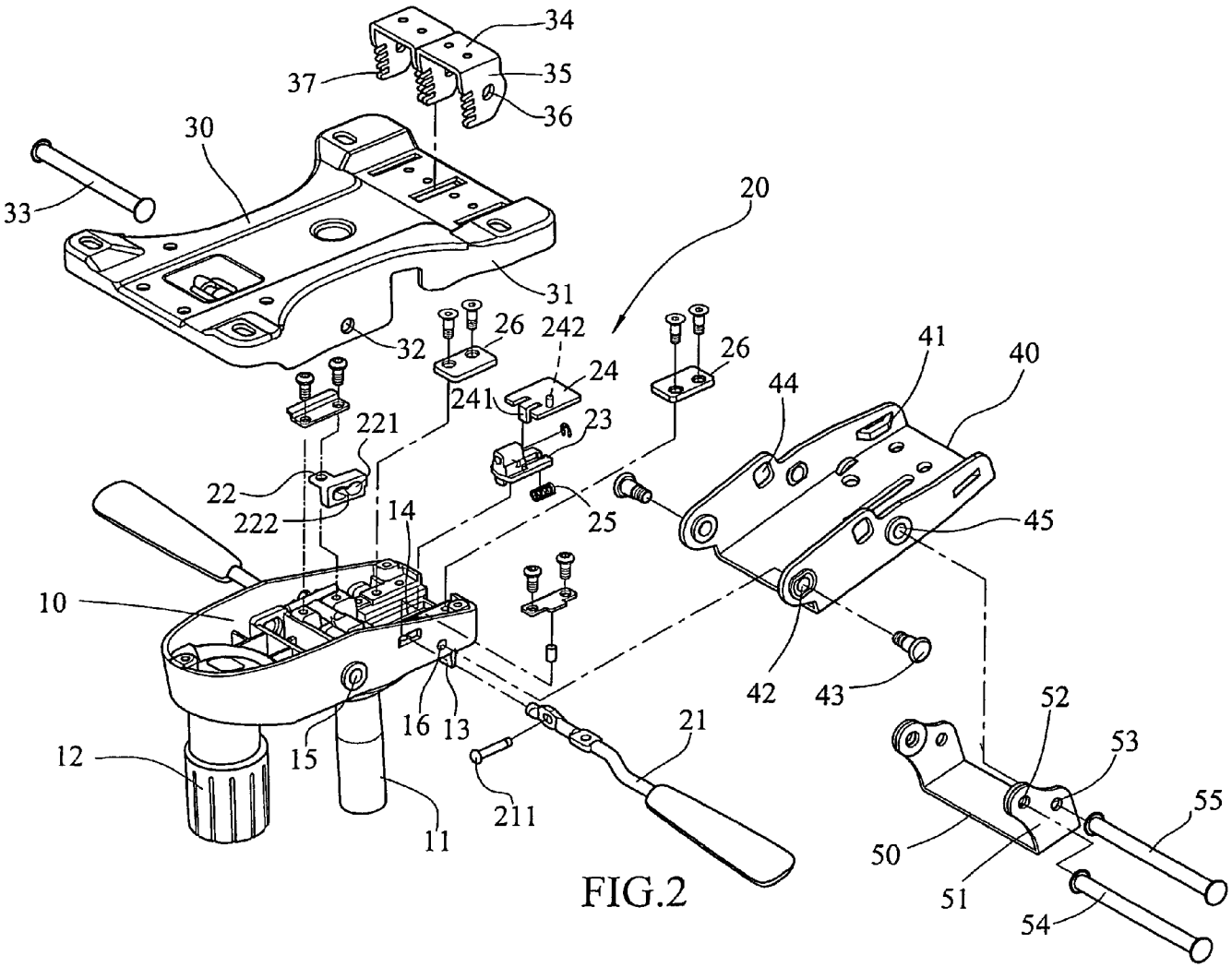
FIG. 2 is an exploded view to show the chair adjustable device of the present invention.
Figure 3:
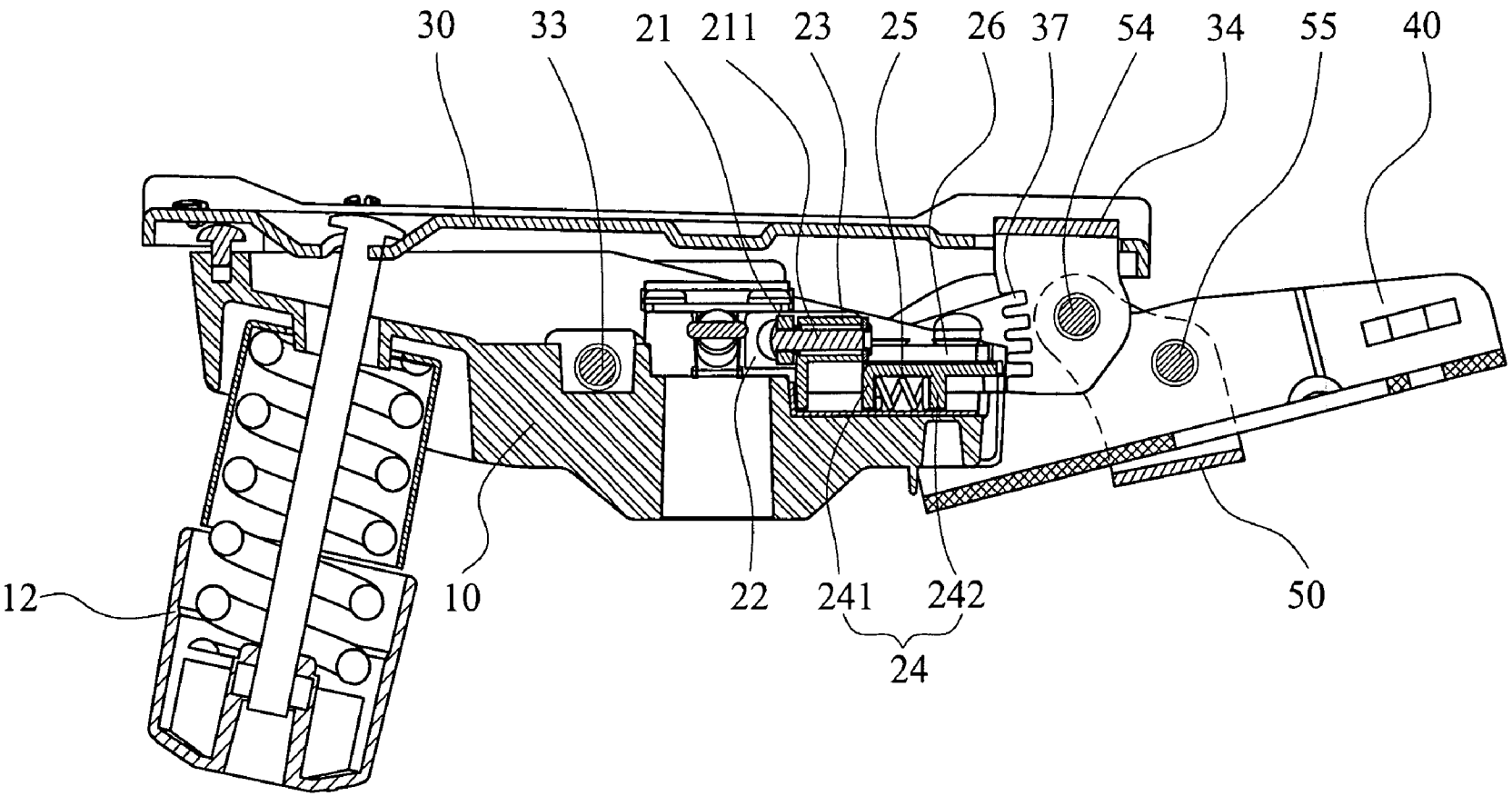
FIG. 3 is a side cross sectional view of the chair adjustable device of the present invention.
Figure 4:
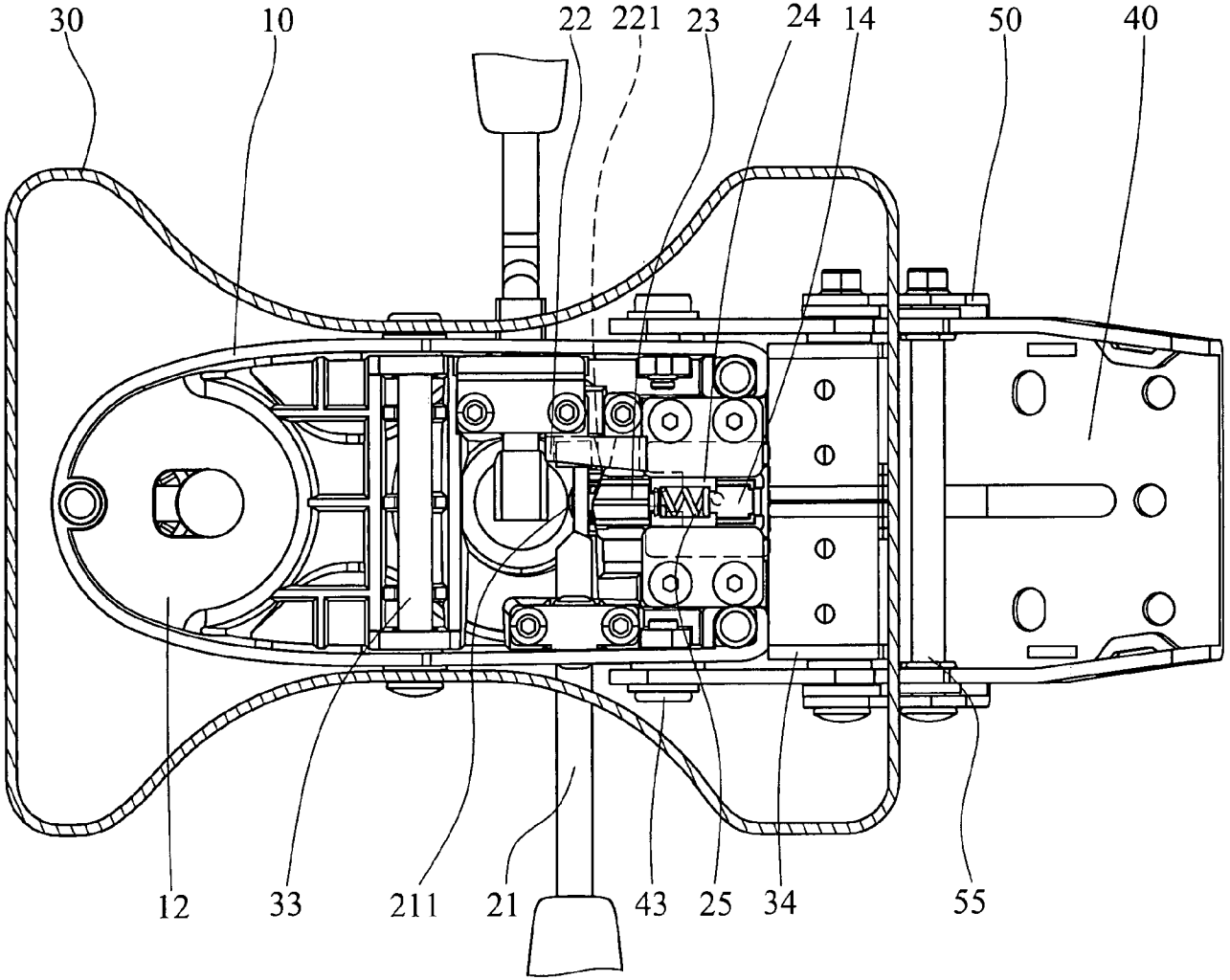
FIG. 4 is a top view of the chair adjustable device of the present invention.

Referring to FIGS. 1 to 4, the chair adjustable device of the present invention comprises a base 10 which includes two sidewalls and a chamber 14 is defined in a top thereof. The seat post 11 is connected to a mediate portion of an underside of the base 10 and a spring box 12 is connected to a front end of the underside of the base 10, both of the seat post 11 and the spring box 12 are well known and will not described in detail.

A seat frame 30 pivotably connected to two sidewalls of the base 10 by a pin 33 extending through holes 32 in two sides 31 of the seat frame 30 and two holes 15 of the base 10. A positioning member 34 is connected to a rear end of the base 10 and includes two sides 35 and each of the two sides 35 has a plurality notches 37.

A backrest frame 40 is pivotably connected to a rear end of the base 10 by extending two positioning members 43 through holes 16 in the two sidewalls of the base 10 and two holes 42 in two sides 41 of the backrest frame 40. A connection member 50 located at an underside of the backrest frame 40 and includes two lugs 51 which are respectively pivotably connected to the backrest frame 40 and the positioning member 34 of the seat frame 30. Each of the two lugs 51 of the connection member 50 has a first hole 52 and a second hole 53 which is located below the first hole 52. Two pins 54, 55 respectively extend through the first and second holes 52, 53, the holes 36 in the two sides 35 of the positioning member 34 and holes 44, 45 defined through two sides 41 of the backrest frame 40. Therefore, the seat frame 30 and the backrest frame 40 are able to be pivoted as one piece.

A positioning mechanism 20 is received in the chamber 14 of the base 10 and an operation handle 21 movably extends through one of the two sidewalls of the base 10. A distal end of the operation handle 21 is movably engaged with a fixed member 22 which includes two positioning holes 221 with two flexible protrusions 222 extending between the two positioning holes 221, a gap is defined between the two protrusions 222 so that the distal end of the operation handle 21 can be moved through the gap while engaged with either one of the two positioning holes 221.

Figure 7A:
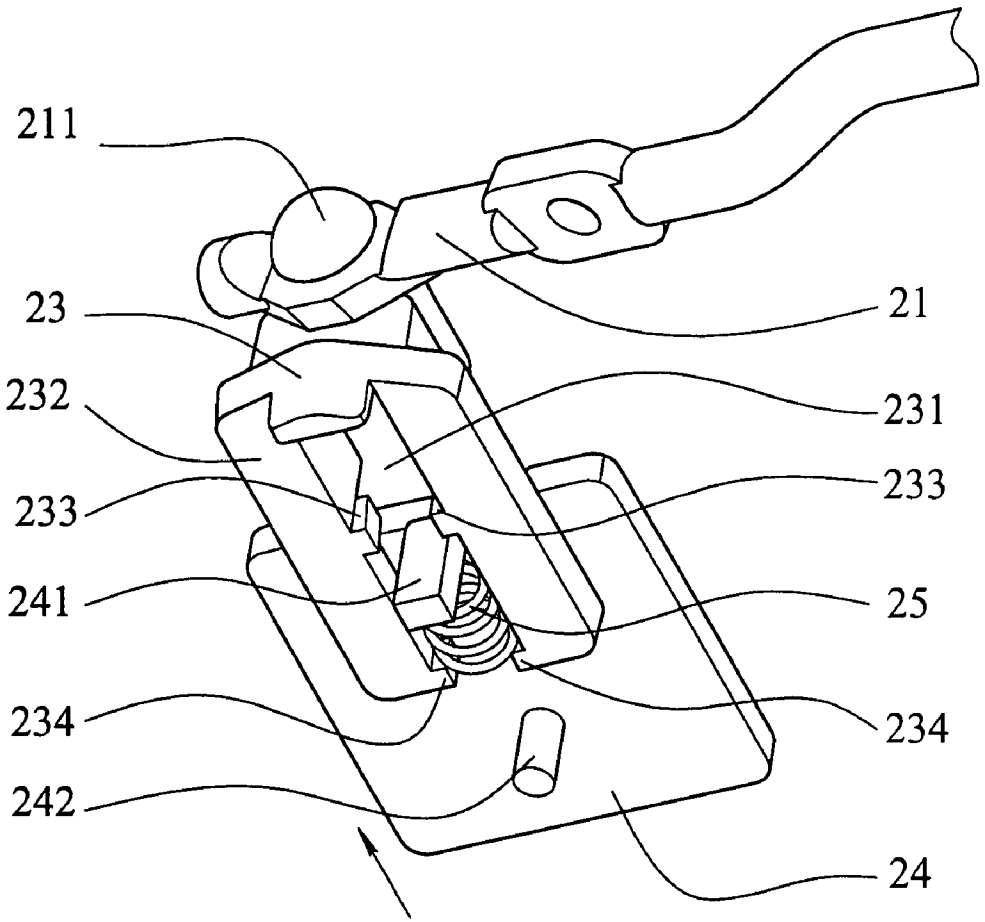
FIGS. 7A and 7B show two positions of the positioning plate relative to the transmission frame.
Figure 7B:
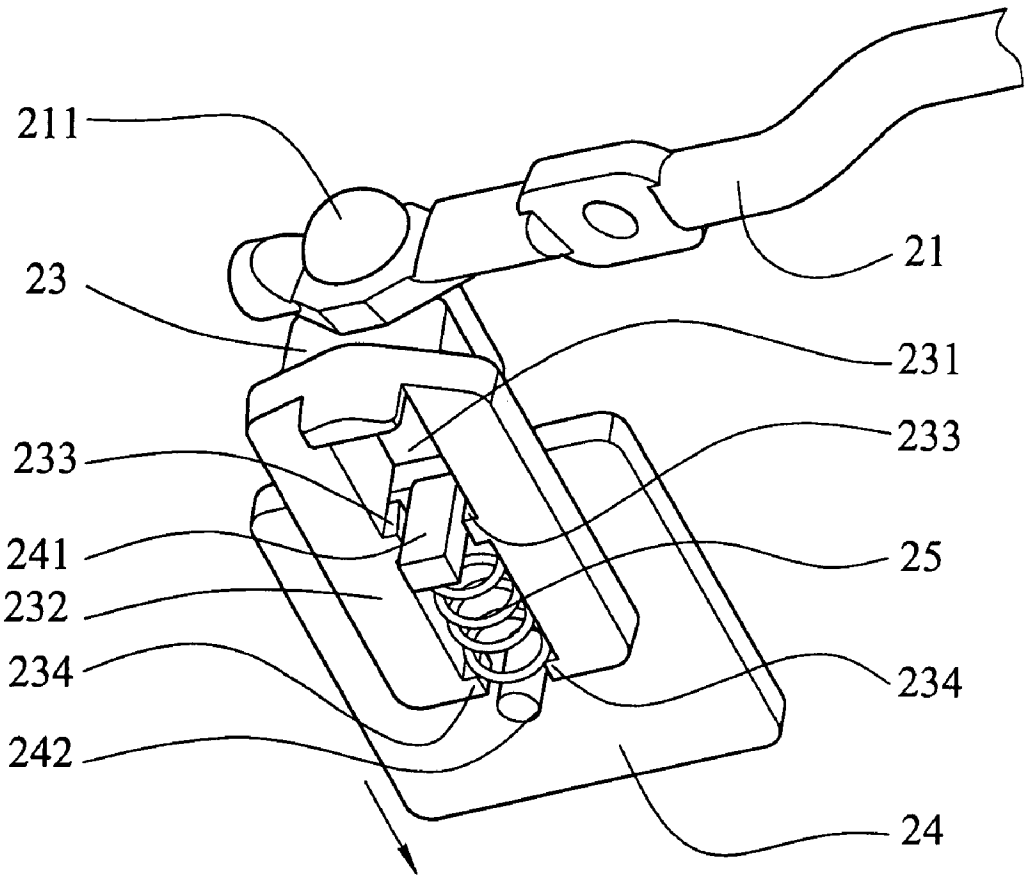

Further referring to FIGS. 7A and 7B, a transmission frame 23 is connected to a side of the operation handle 21 in the base 10 by a pin 211 so that the transmission frame 23 is movable with the operation handle 21. A positioning plate 24 is movably connected to the transmission frame 23 and biased by a spring 25. The transmission frame 23 includes a slot 231 defined through a bottom 232 thereof and a first pair of stops 233 and a second pair of stops 234 extend from two facing insides of the slot 231 at a distance. An extension 241 extends downward from a front end of the positioning plate 24 and a rod 242 extends from an underside of the positioning plate 24. The extension 241 is movably received in the slot 231 and the spring 25 is received in the slot 231. Two ends of the spring 25 are stopped by the first pair of stops 233 and the second pair of stops 234. Two pressing plates 26 are connected to the base 10 so as to press on two sides of the positioning plate 24 to restrict upward movement of the positioning plate 24.

Figure 5:
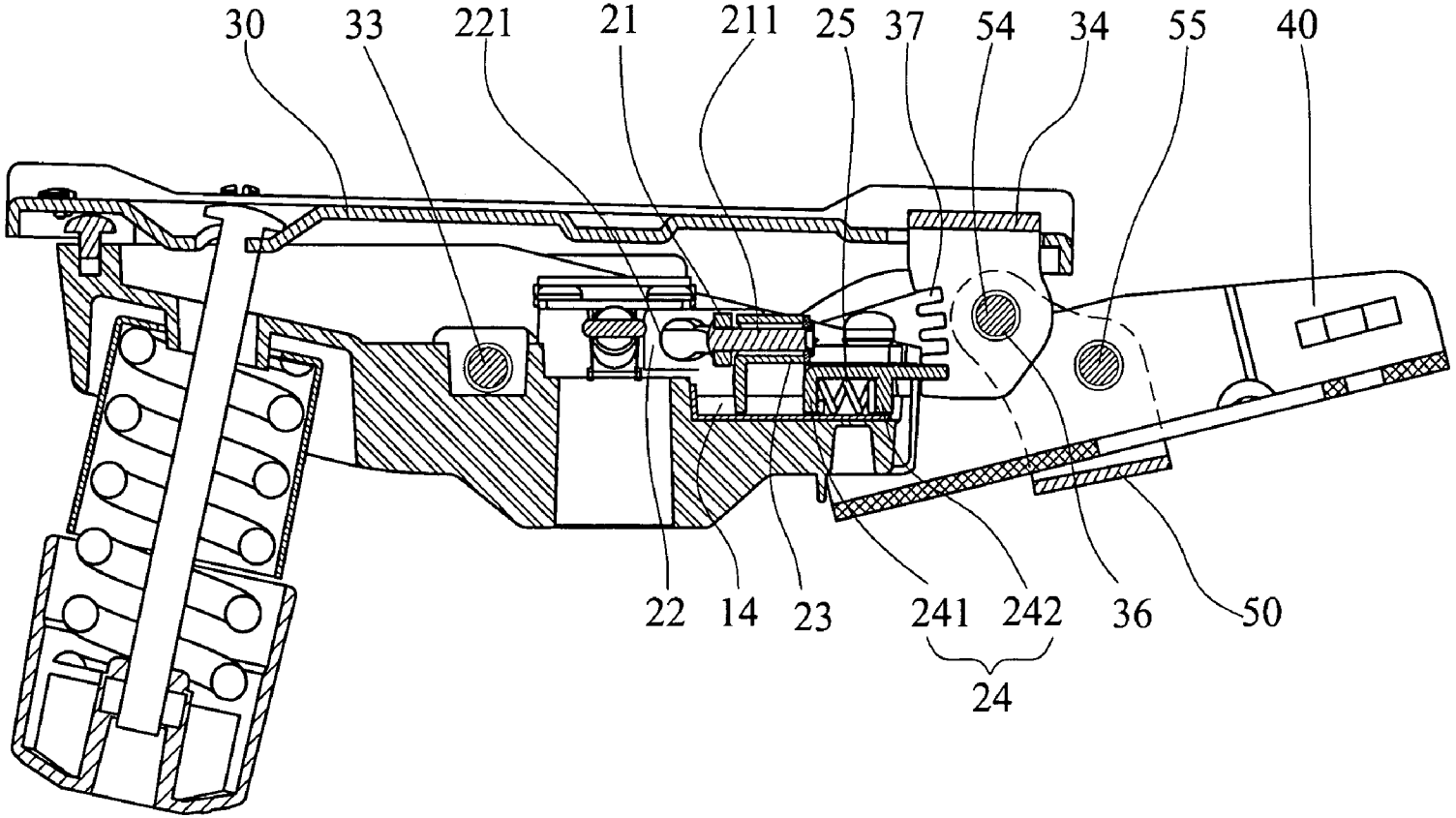
FIGS. 5 and 6 show two positions of the chair adjustable device of the present invention.
Figure 6:
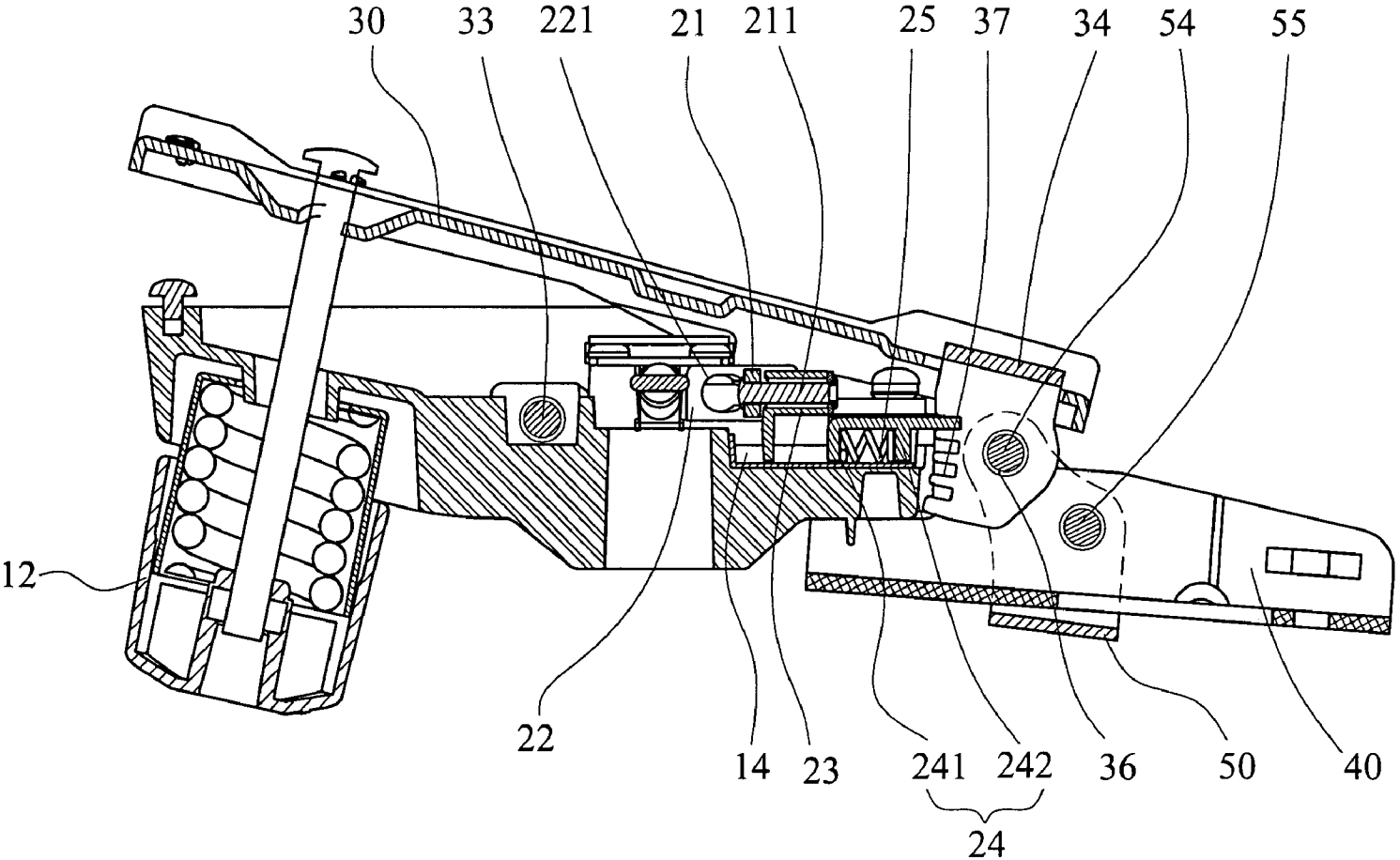

Referring to FIGS. 5 and 6, when the user shifts the operation handle 21 to move the transmission frame 23 away from the positioning plate 24 as shown in FIG. 7A, the positioning plate 24 is disengaged from the notches 37 of the positioning member 34 and the user uses his body to decline the backrest of the chair till desired angle, the operation handle 21 is released and the positioning plate 24 is engaged with another positions of the notches 37 again. The positioning plate 24 can be engaged with different notches 37 so as to limit the tilt angle of the seat frame 30. The angle that the backrest frame 40 tilts is also limited because of the connection of the seat frame 30 and the backrest frame 40. The base 10 includes a safety board 13 on a rear end thereof to prevent user's finger to be clamped during adjustment.

The number of components of the chair adjustable device is less than the conventional chair adjustable device and the chair adjustable device of the present invention uses only one spring 25 to achieve the purpose of adjustment. The positioning plate 24 can be directly engaged with the notches 37 of the positioning member 34 so that the adjustment is reliable and precisely. The seat frame 30 and the backrest frame 40 are connected with each other by the connection member 50 so that the tilt angle of the chair can be easily adjusted by operating the operation handle 21.

Figure 8A:
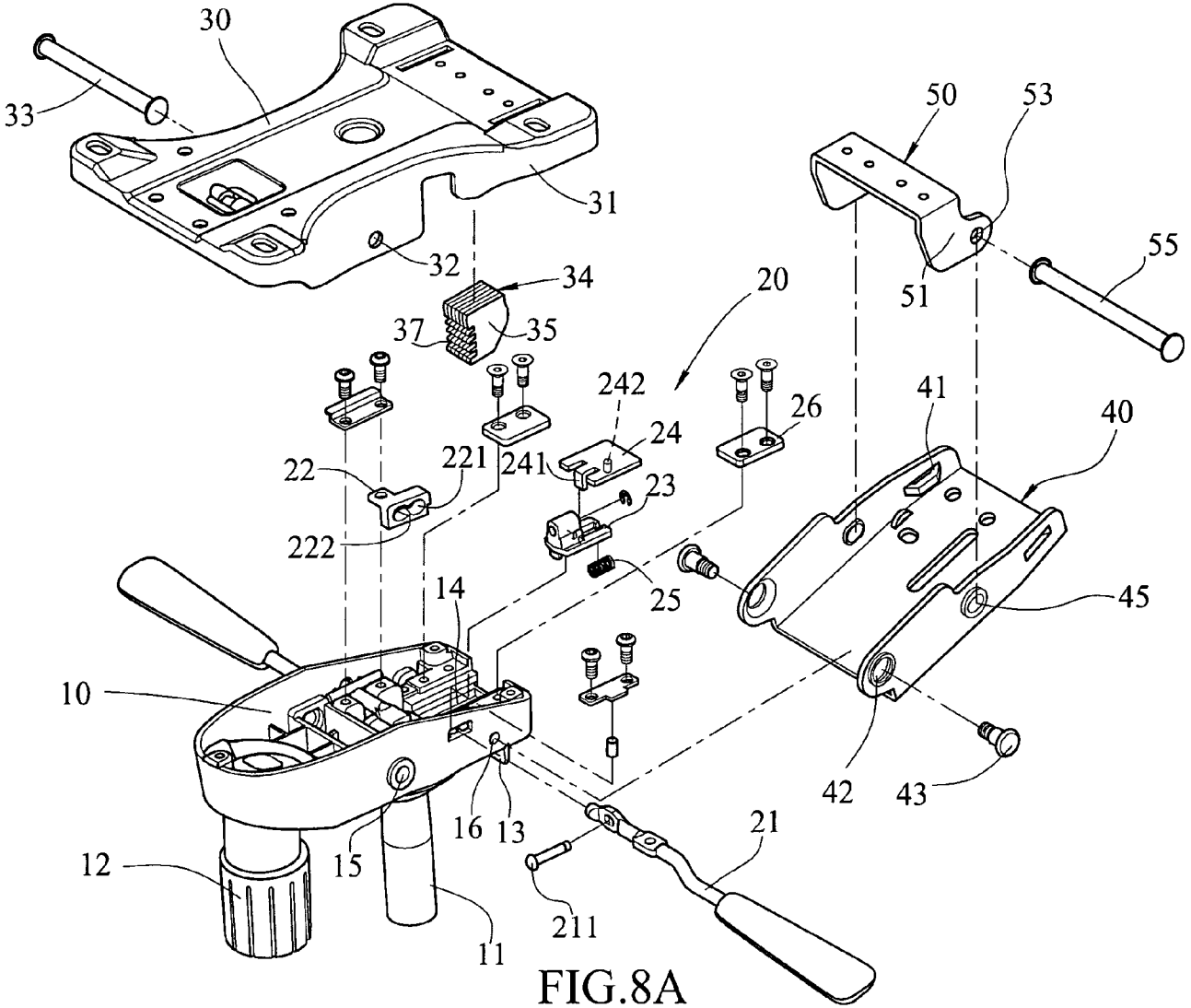
FIGS. 8A and 8B shows another embodiment of the present invention.
Figure 8B:
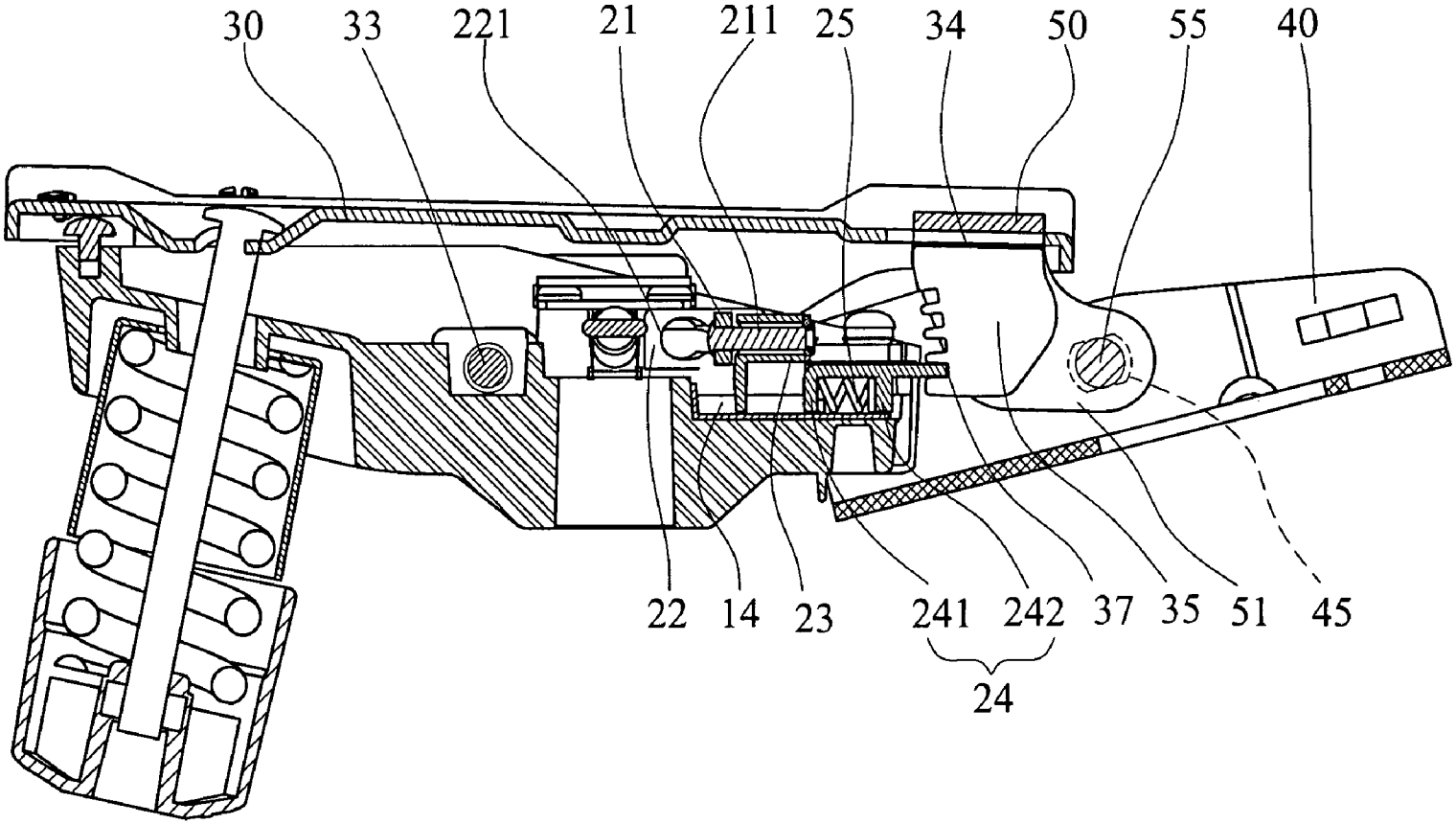
Figure 9:
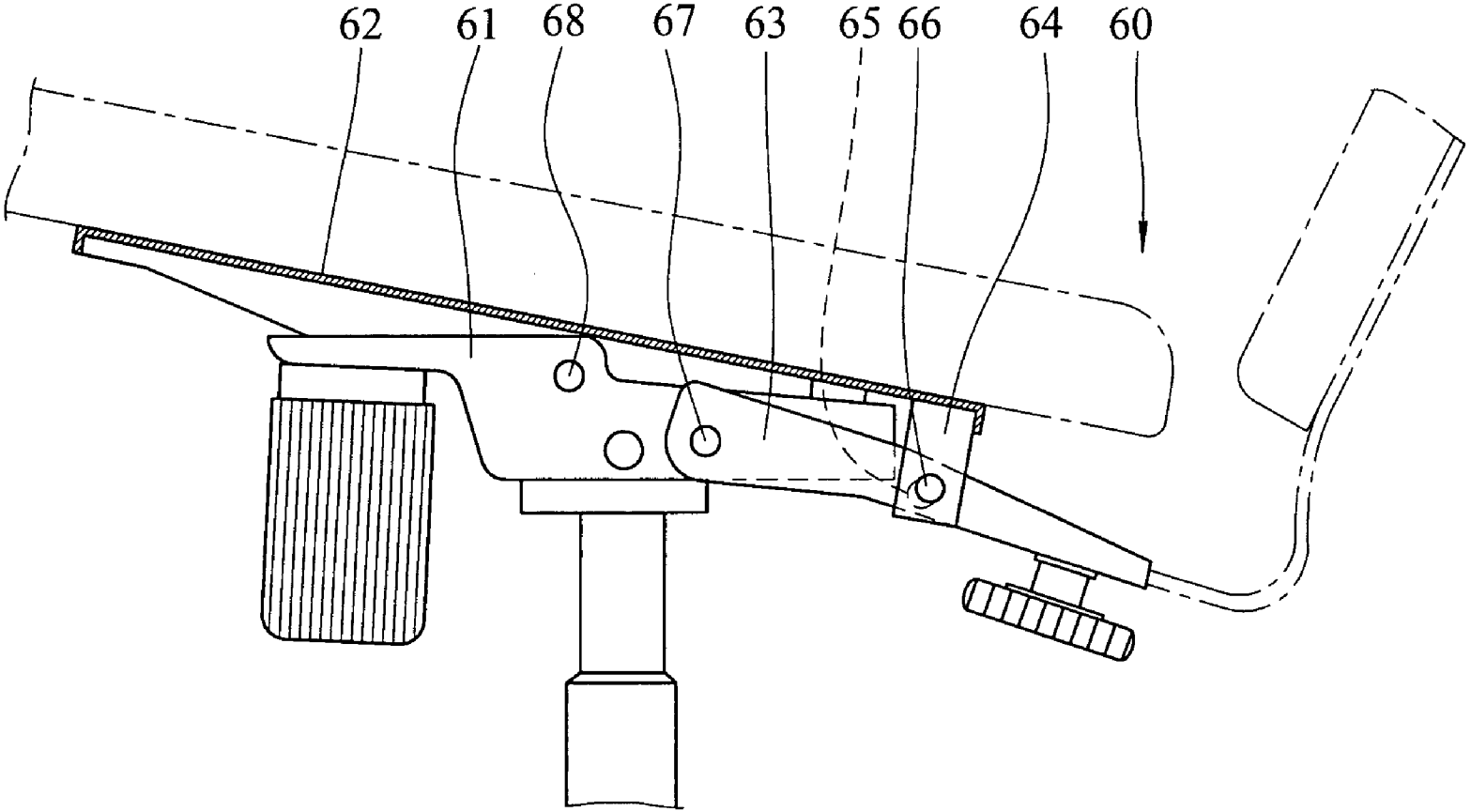
FIG.9 PRIOR ART
FIG. 9 shows a conventional chair adjustable device.
Figure 10:
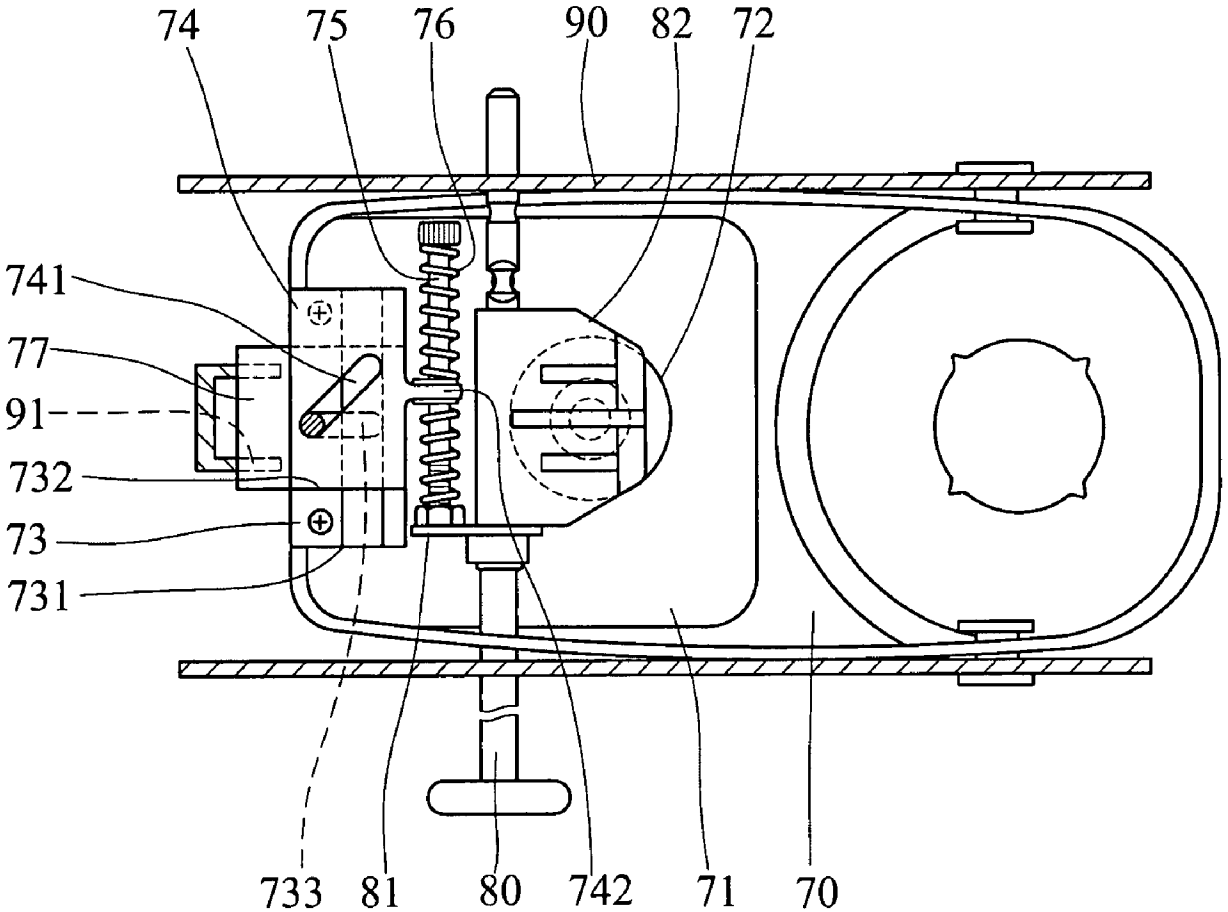
FIG.10 PRIOR ART
FIG. 10 is a top view of the conventional chair adjustable device.
Figure 11:
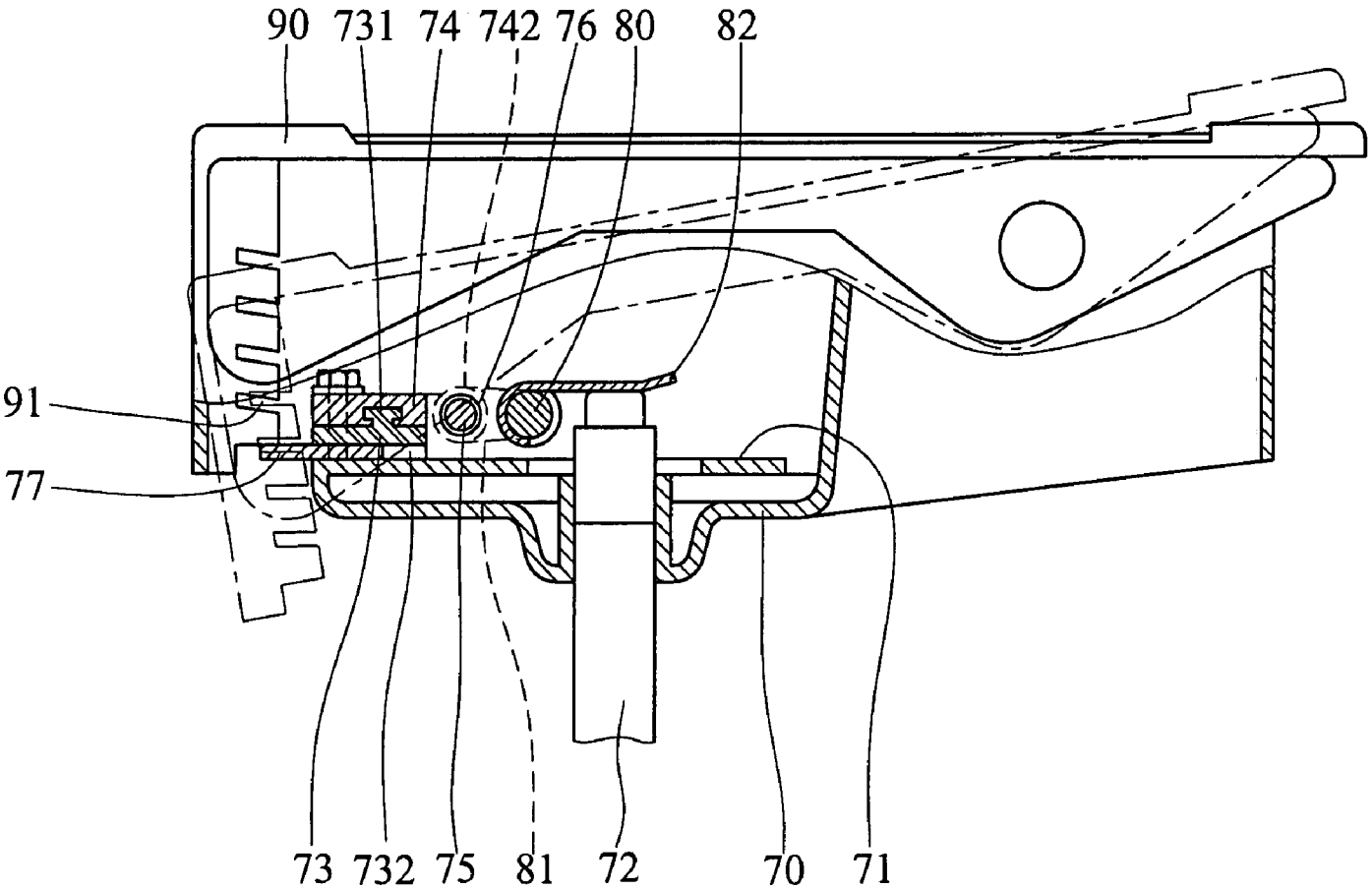
FIG.11 PRIOR ART
FIG. 11 is a cross sectional view of the conventional chair adjustable device.

As shown in FIGS. 8A and 8B which show another embodiment of the present invention, wherein the connection member 25 is arranged such that the two lugs 51 face and are connected to the seat frame 30. The lugs 51 each have a second hole 53 and the pin 55 extends through the second dholes 53 and the holes 45 in the backrest frame 40. The top of the positioning member 34 is fixed to the underside of the seat frame 30 and a plurality of positioning notches 37 are defined in a side thereof. When in use, the user's body pushes the backrest backward which is pivoted an angle about the positioning member 43. The operation handle 21 is then operated to activate the positioning mechanism 20 such that the transmission frame 23 drives the positioning plate 24 radially by the spring 25 to engaged a rear end of the positioning plate 24 with one of the notches 37.

While we have shown and described the embodiment in accordance with the present invention, it should be clear to those skilled in the art that further embodiments may be made without departing from the scope of the present invention.

What is claimed is:

1. A chair adjustable device comprising: a base; a seat frame pivotably connected to two sidewalls of the base and having a positioning member connected to a rear end thereof; a backrest frame pivotably connected to a rear end of the base; a positioning mechanism connected to the base and an operation handle movably extending through one of the two sidewalls of the base, a distal end of the operation handle movably engaged with a fixed member, a transmission frame connected to a side of the operation handle in the base and movable with the operation handle, a positioning plate movably connected to the transmission frame and biased by a spring so as to be engaged with the positioning member on the seat frame and control the inclination of the seat frame, and a connection member located at an underside of the backrest frame and including two lugs which are respectively pivotably connected to the backrest frame and the positioning member of the seat frame;

wherein the transmission frame includes a slot defined through a bottom thereof and a first pair of stops and a second pair of stops extend from two facing insides of the slot at a distance, an extension extends downward from a front end of the positioning plate and a rod extends from an underside of the positioning plate, the extension is movably received in the slot and the spring is received in the slot, two ends of the spring are stopped by the first pair of stops and the second pair of stops.

2. The device as claimed in claim 1, wherein each of the two lugs of the connection member has a first hole and a second hole which is located below the first hole, two pins respectively extend through the first and second holes, the holes in two sides of the positioning member and holes defined through two sides of the backrest frame.

3. The device as claimed in claim 1, wherein the positioning member includes two sides and each of which has a plurality notches with which the positioning plate is engaged.

4. The device as claimed in claim 1, wherein two pressing plates are connected to the base and press on two sides of the positioning plate to restrict movement of the positioning plate.

5. The device as claimed in claim 1, wherein the base includes a safety board on a rear end thereof.

6. The device as claimed in claim 1, wherein the seat post is connected to a mediate portion of an underside of the base and a spring box is connected to a front end of the underside of the base.

* * * * *